United States Patent [19]

Sagi et al.

[11] 3,937,323

[45] Feb. 10, 1976

[54] PROTECTIVE FRANGIBLE DISPENSING ENCLOSURE FOR ARTICLE

[75] Inventors: Zsigmond L. Sagi, Parsippany; Robert A. Lang, East Hanover; Jimmie D. Scott, Parsippany; Berel Weinstein, Fort Lee; Charles G. Pickett, Andover, all of N.J.

[73] Assignee: Bio-Medical Sciences, Inc., Fairfield, N.J.

[22] Filed: Jan. 28, 1974

[21] Appl. No.: 437,035

Related U.S. Application Data

[63] Continuation of Ser. No. 402,006, Sept. 1, 1973, abandoned.

[52] U.S. Cl. ..... 206/306; 156/584; 206/498

[51] Int. Cl.[2] ..... B65D 17/24; B65D 85/16; B32B 35/00

[58] Field of Search ..... 206/306, 498; 156/584

[56] References Cited

UNITED STATES PATENTS

| | | | |
|---|---|---|---|
| 3,072,248 | 1/1963 | Bishop | 206/498 |
| 3,086,647 | 4/1963 | Krezanoski | 206/498 |
| 3,186,628 | 6/1965 | Rohde | 206/498 X |
| 3,677,866 | 7/1972 | Pickett et al. | 156/584 |
| 3,835,990 | 9/1974 | Sagi et al. | 206/306 |

*Primary Examiner*—Leonard Summer

*Attorney, Agent, or Firm*—Anthony Lagani, Jr.

[57] ABSTRACT

A package for the complete and protective enclosure of an article is described in which the article is fully enclosed by a continuous surface of rigid or semi-rigid material so as to form a housing. The housing is banded by a section of sufficiently reduced wall thickness to permit the frangible separation of the housing into two segments which are then drawn apart with the enclosed article being engaged by one of the segments for withdrawal from the other segment. The article can be fully assembled or partially assembled while in the package and means are described in the latter instance for dispensing the fully assembled article automatically in the course of removing it from the package.

14 Claims, 13 Drawing Figures

FIG. 8A
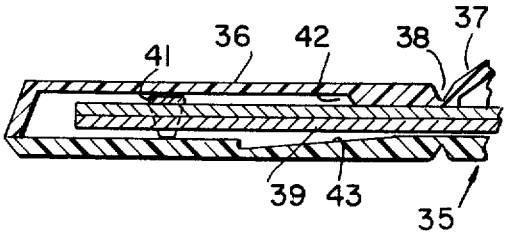
FIG. 8B
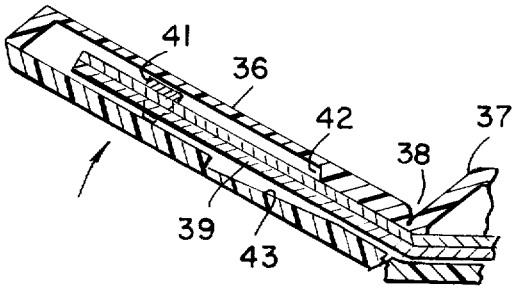
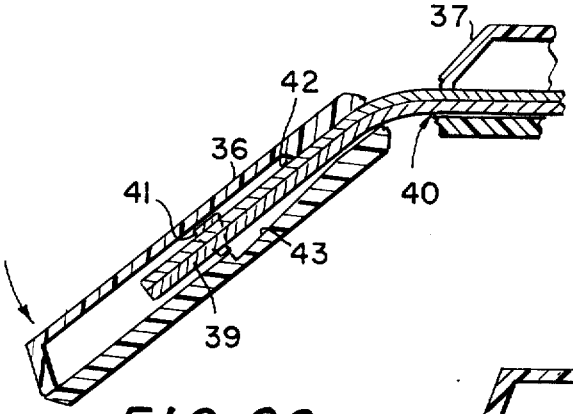
FIG. 8C
FIG. 8D
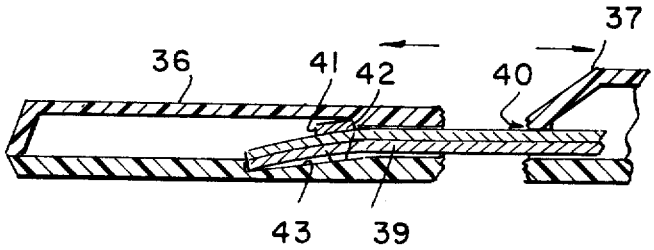
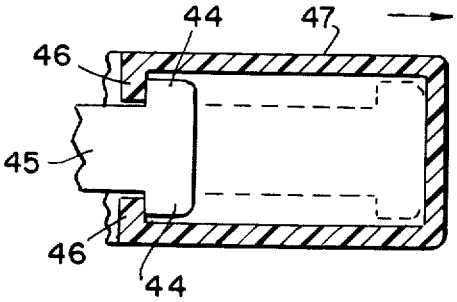
FIG. 9
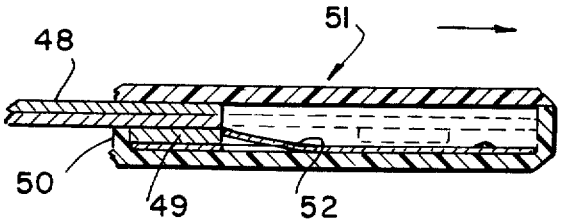
FIG. 10

PROTECTIVE FRANGIBLE DISPENSING ENCLOSURE FOR ARTICLE

CROSS-REFERENCE

This is a continuation of Ser. No. 402,006 filed Oct. 1, 1973, now abandoned.

DETAILED DESCRIPTION

The present invention pertains to packages which afford complete and protective enclosure for various articles prior to use but from which the article can be readily obtained for use. In one embodiment, the packages also serve a dispensing function so that the article can be packaged in partially or pre-assembled form, which for various reasons is often desirable, but dispensed in fully assembled form in the course of removal from the package.

The complete and protective enclosure afforded by the present package isolates the product from the influences of light, air, moisture, excessive force, microorganisms, human tampering, and similar undesirable elements. Not all these elements may be detrimental to a given product or article and generally a given package is designed to protect the product from only those elements which are detrimental to it.

Typical articles for which such packaging is desirable include for example surgical and dental applicators and equipment, diagnostic devices, eating utensils, film plates, thermometers, environmental test systems and the like. By the very nature of the package, it is generally suitable for "one-time" use and thus while not required, now abandoned the products or articles for which it is most advantageous are those of the "disposable" type. For example, a disposable surgical swab of silver nitrate can be packaged in accordance with the present invention so as to be protected from the detrimental effects of light. Disposable sutures can be packaged in accordance with the present invention under aseptic conditions. Chemical sensors utilized to detect the presence of various gases or materials in the atmosphere can be packaged in a ready state to permit storage until ready for use. Various other applications will immediately be apparent to workers in these arts.

For the sake of concise exemplification, the package is described herein with reference to a known type of disposable thermometer which poses many of the packaging problems presented by other products.

There is described in U.S. Pat. No. 3,665,770 a disposable thermometer having a thermally conductive sheet, such as aluminum foil, in which there is a number of cavities or depressions. Each cavity is filled with a material which melts at a distinct temperature so that the particular cavities in which melting occurs is an indication of the temperature of the subject being tested. Indicator means cooperating with an acceptor visually indicate these individual changes of state.

It is of course desirable that such a thermometer be kept sterile prior to use and that it not be exposed to excessive actinic radiation. It is also desirable that such a thermometer be protected from crushing and similar physical stresses prior to use. The present package provides such protection and yet permits the rapid removal of the product for immediate use.

Moreover it is desirable that the product be transported or stored in a partially or preassembled form. Thus if subjected to excessive heat in its fully assembled form, the thermometer of U.S. Pat. No. 3,665,770 will react or "fire" and thus be unsuitable for subsequent clinical use. Suitable partial or preassembled forms of the thermometer in which the conductive layer carrying the heat responsive material is separated from the indicator and acceptor layer by a peelably removable shield are fully described in U.S. Pat. Nos. 3,667,088 and 3,712,141. The present packaging also permits the storage of such a product in such a partial or preassembled form with the dispensing of a fully assembled thermometer; i.e., removal of the shield and registry of the two layers in adhesive face-to-face contact.

Other advantages and features of the present invention will be apparent from the description contained herein and from the accompanying drawing in which:

FIGS. 8A, 8B, 8C and 8D are a series of vertical sections diagrammatically depicting a typical article engaging means similar to that depicted in FIGS. 3, 4 and 5, the levering action applied to separate the housing into two segments, and the sliding and locking action of the article in one of the segments.

FIG. 9 is a top view in section of an alternative article engaging means; and FIG. 10 is a side view in section of other alternative article engaging means and locking means.

Figure 1:
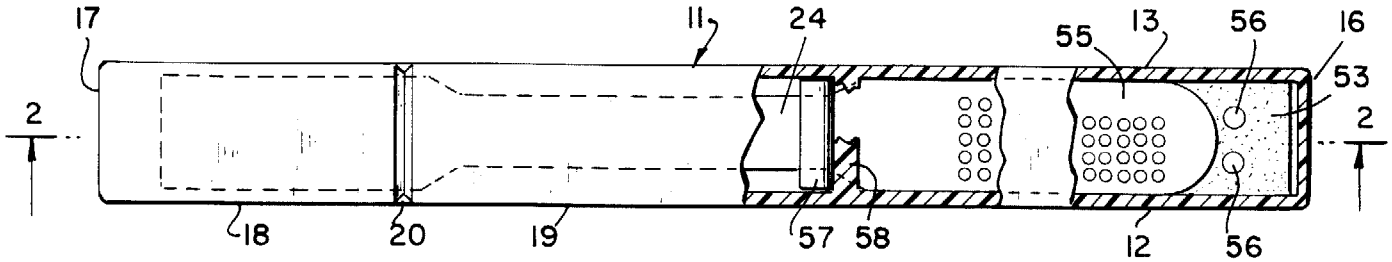
FIG. 1 is a plan view of a package in accordance with the present invention with portions of the housing broken away to depict various optional features of the interior structure.
Figure 2:
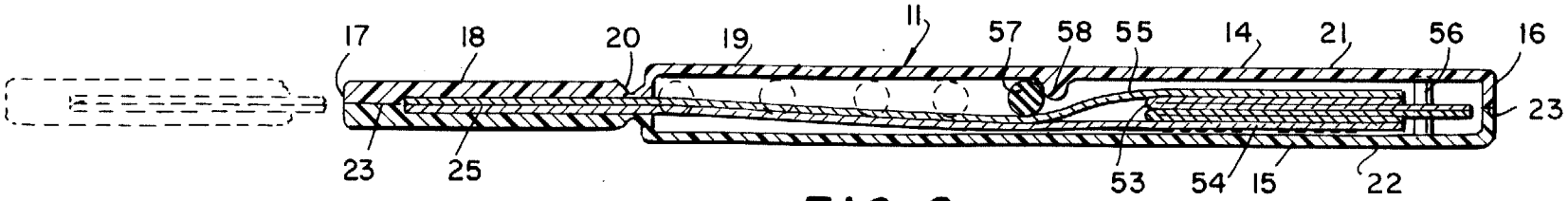
FIG. 2 is a longitudinal vertical section view of the package shown in FIG. 1 taken along line 2—2 of FIG. 1.

Referring now to FIGS. 1 and 2 in detail, there is shown a package having a hollow housing 11 of rigid or semi-rigid material having opposed, spaced apart main side walls 12, 13, 14 and 15 and end walls 16 and 17 defining a continuous surface fully enclosing the article. The housing is divided into first and second segments 18 and 19 respectively by band 20, intermediate to end walls 16 and 17, defined in side walls 12, 13, 14 and 15 by a section of reduced wall thickness. The reduced section can be in two opposing walls or on all four walls. Its function is to permit the frangible separation of housing 11 along the section into its two segments 18 and 19 upon the application of a levering force, as discussed below in greater detail in connection with FIGS. 8A–8D.

Housing 11 is conveniently fabricated from two coextensive housing shells 21 and 22 of a rigid or semi-rigid material such as polyvinyl chloride, polycarbonate, polystyrene, metal or the like. Shells 21 and 22 have complementary surfaces which are joined to one another in sealed connection 23. The nature of the sealant is relatively unimportant provided it is complete. It can for example be a conventional plastics adhesive or glue, or a solder in the case of metals. In those instances in which the rigid or semi-rigid material is thermoplastic and self heat sealable, such as is polystyrene, the two shells can be heat sealed. The individual shells can be identical in configuration, as in the embodiment of FIGS. 1 and 2, or can be of different shapes, as in the embodiment of FIG. 3.

The article is thus completely and protectively enclosed within housing 11 upon the sealing of shells 21 and 22. It is released from the housing by applying a levering force about band 20 until segment 18 is separated from segment 19. One of the segments contains article engaging means so as to function as a handle in removing the article from the other segment. Thus in FIGS. 1 and 2, there is shown the components of a disposable thermometer 24 of a type well known. While this is described below in greater detail in connection with the dispensing function of the thermometer, suffice it to note here that the thermometer's handle portion 25 is permanently fixed to housing segment 18 as for example by heat sealing, crimping or the application of adhesive. Consequently segment 18 serves as a handle for thermometer 24 following frangible separation of the housing, both for withdrawal of the thermometer and for subsequent use. The advantages of maintaining the sterility of the thermometer itself are immediately apparent.

It is not necessary that the article be permanently and unmovably fixed to one of the housing segments. Indeed certain advantages can be realized by embodiments in which the article is allowed to move to some degree within the housing segment in question but prevented by engaging means from being completely withdrawn. Such embodiments are shown in FIGS. 3–5, 8A–D, 9 and 10.

Figure 3:
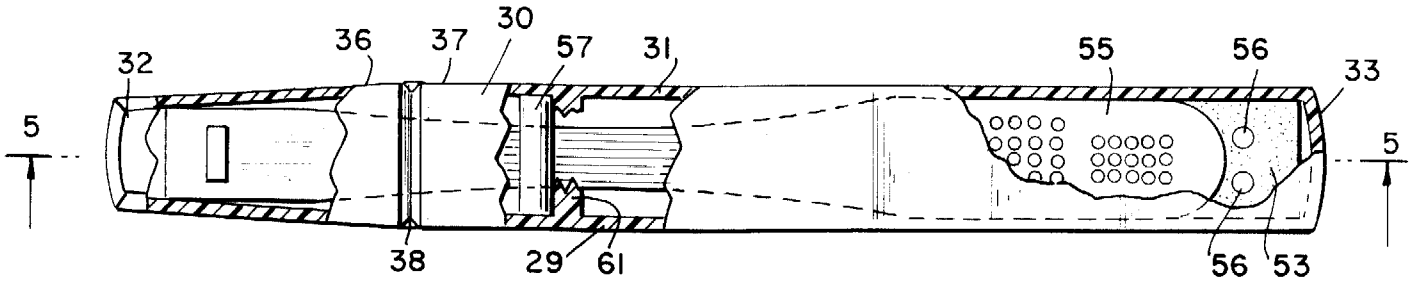
FIG. 3 is a plan view of a second embodiment of the present invention with portions of the housing broken away to depict various optional features of the interior structure.
Figure 4:
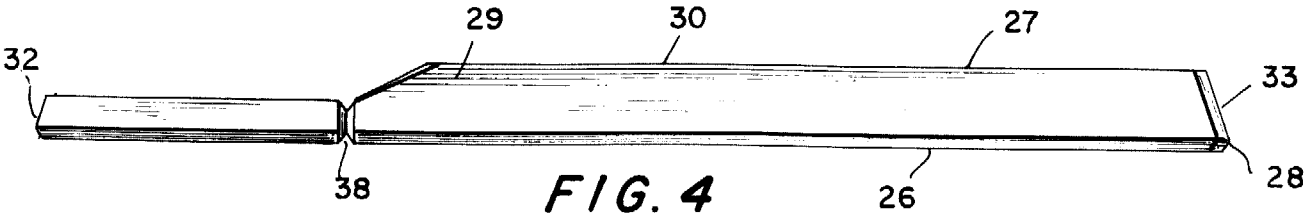
FIG. 4 is a side elevation of the embodiment depicted in FIG. 3.
Figure 5:
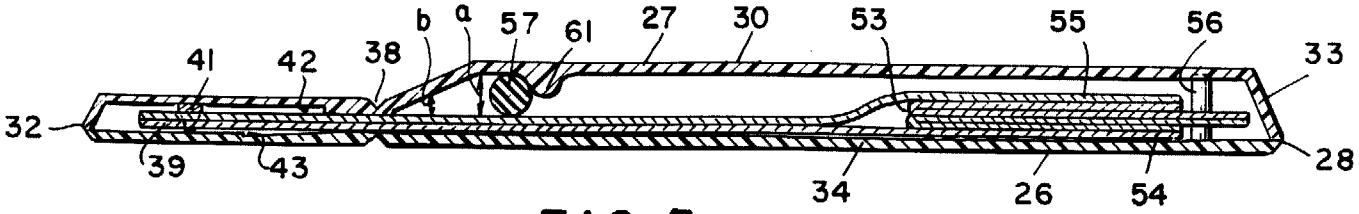
FIG. 5 is a longitudinal vertical section view of the package shown in FIG. 1 taken along line 5—5 of FIG. 3.

Referring now to FIGS. 3, 4, and 5 there is depicted a further embodiment of the package according to the present invention. The package of FIGS. 3, 4, 5 differs in a number of respects from that of FIGS. 1 and 2. First, shells 26 and 27 are different from one another in configuration so that when viewed along sealed connection 28, the outside configuration of the package is unsymetrical. Moreover, shell 27 provides side walls 29, 30, and 31 and end walls 32 and 33 of the final housing while shell 26 provides bottom side wall 34. In addition, the package of FIGS. 3, 4, and 5 utilizes article engaging means which permit limiting sliding of the article within one housing segment following frangible separation but which limits this sliding so as to prevent removal of the article from that segment. As a result of this feature, a portion of the article is stored in that housing segment employed for grasping purposes and upon sliding partially out of this segment, provides additional usable length for the article. The length of the unseparated package can accordingly be kept to a minimum. Other differences are discussed below.

The nature of the frangible separation of the two housing segments can be seen from FIGS. 8A–8D where it will be noted that housing 35 is divided into first segment 36 and second segment 37 (shown in part) by band 38 of reduced wall section. Upon the application of levering force in one direction, this band undergoes at least partial separation of one wall, as shown in FIG. 8B, and a weakening of the remaining walls. A further levering force in the opposite direction then results in complete separation of segments 36 and 37, as shown in FIG. 8C. It is to be appreciated that the break line has been exaggerated in FIG. 8A–8D and the break is of course much cleaner. Following complete separation of segments 36 and 37, they are merely pulled apart in opposed directions, as shown in FIG. 8D. This results in strip 39 of the article sliding through opening 40 until article stop means 41 engages shoulder 42 which is defined on the inside surface of segment 36. The portion of strip 39 which was previously contained in segment 36 is thus made available to extend the usable length of the article in question.

In order to insure that this extended portion of the article does not retract into segment 36, suitable locking means are provided. One such locking means, shown in FIG. 8A–8D, involves detent 43 which is positioned for engaging cooperation with the extreme end of article strip 39. When article stop means 41, which may be a simple staple, engages shoulder 42, a slight pivoting action occurs and the end of article strip 39 is in turn engaged by detent 43. As a result, the slipping movement of strip 39 becomes irreversible once article stop means 41 engages shoulder 42.

Other article stop means can be employed with similar results. One such arrangement is shown in FIG. 9 in which tabs 44 on article strip member 45 engage stop abutment 46 in the course of withdrawing strip member 45 from housing segment 47.

A further embodiment is depicted in FIG. 10 in which strip member 48 and article stop means 49 are locked against shoulder 50 of housing segment 51 by spring means 52. Other article engaging means and locking means will of course be immediately apparent to those skilled in the art.

In addition to the above advantages of the present package, one can incorporate certain dispensing features into its design and structure so that a partially assembled or preassembled product can be dispensed in fully assembled form in the course of opening the package and removing the article or a product therefrom. By way of example, there is shown in FIGS. 1–5 certain elements of a disposable thermometer. As noted above, this laminated product is preferably transported and stored with shield 53 intervening the two operable strips, carrier strip 54 and indicator strip 55, which together form the temperature indicating portion of the thermometer.

In order to utilize a thermometer of this type, it is necessary to peelably remove shield 53 from strips 54 and 55 and to then bring the strips together in face-to-face registry and joined connection, one of the strips carrying a contact adhesive material of the type well known.

The first operation is initiated automatically in a package according to the present invention after frangible separation of the two segments and engagement of the product by one of the segments. Thus in the embodiment of FIGS. 1 and 2 in which thermometer handle portion 25 is fixed to segment 18, opposed separation of segments 18 and 19 will effect peelable separation of strips 54 and 55 from shield 53 which is anchored to posts 56, or a similar product engaging means, disposed on the inside portion of housing 11 corresponding to segment 19.

A similar operation occurs in the embodiment of FIGS. 3–5 except that peelable separation of strips 54 and 55 from shield 53 is not initiated until article stop means 41 engages shoulder 52 (see FIG. 8D).

The adhesive contact of strips 54 and 55 in face-to-face registry following peeable separation of shield 53 is accomplished by presser means. These can include a simple blade (not shown) over which the two strips are drawn or, more advantageously, roller means. In FIGS. 1 and 2, roller 57 is freely disposed in housing 11 in the portion corresponding to segment 19 and in tangential surface contact with the inner surface of top side wall 14 as well as thermometer 24. Consequently, roller 57 rotatably advances towards section 20 in the course of removal of strips 54 and 55 from segment 19 following frangible separation of housing 11 into two segments, 18 and 19. Roller 57 is preferably fabricated from a resilient elastic material such as rubber, neoprene or the like. The pressure resulting from passage of strips 54 and 55 under roller 57 effects adhesive joining of two in face-to-face registry.

In the embodiment of FIGS. 1 and 2, the initial positioning and area of rotatable advancement of roller 57 must be such that the roller is initially and always remains ahead of the advancing juncture of separation of heat shield 53 from strips 54 and 55. Initial positioning of roller 57 can be achieved through the optional inclusion of ridge 58 on the inside surface of housing 11. The inclined disposition of thermometer 24 in segment 19 urges roller 57 against ridge 58 until the package is opened and removal of thermometer 24 and its strip portions 54 and 55 then causes the roller to advance.

It will also be observed in the embodiment of FIGS. 1 and 2 that inside surface of wall 14, with which roller 57 is in contact, and the inside surface of opposing wall 15 are in substantially parallel alignment throughout at least the area of rotatable advancement of roller 57. Since thermometer 24 and its strip portions 54 and 55 pass under roller 57 and emerge at approximately the mid-line of section 19, the above-mentioned incline of thermometer 24 relative to wall 14 results in increasing pressure exerted by advancing roller 57 at the end of peelable separation, relative to the beginning of peelable separation. This advantageous result, which is achieved to even a greater degree with the embodiment of shown FIGS. 3–5, insures complete joining of strips 54 and 55 in adhesive face-to-face registry in the course of removal from the housing.

Figure 6:
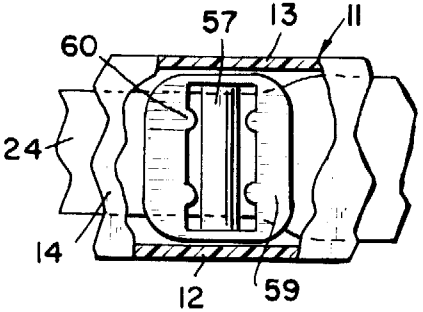
FIG. 6 is a plan view of a portion of a package in accordance with the present invention with portions of the housing broken away to depict a roller which can be alternatively employed in a package such as that depicted in FIGS. 1 and 2.

In an embodiment such as that of FIGS. 1 and 2 in which roller 57 is freely disposed for advancement, it is often desirable to include means to prevent skewing; i.e., means to insure the roller remains parallel to walls 12 and 13 and parallel to the axis of the product by which it is removed from the package. This can be accomplished for example in the manner shown in FIG. 6 in which roller 57 is disposed in carriage 59 within housing 11. Carriage 59 is essentially a rectangular plate which engages and advances with roller 57. Carriage 59 is of a width just less than the inside width of the housing and its sides are parallel to the inside surfaces of side walls 12 and 13. Friction between carriage 59 and roller 57 can be reduced if the carriage's roller retention means are simply rounded guide projections 60.

As noted above, the roller means must always be ahead of the advancing juncture of separation of the heat shield and the strips of the thermometer intervened thereby. In place of a freely disposed roller which advances within the housing, it is possible and often desirable to advance the initial positioning of the roller beyond the furthest point to which the separation junction reaches. One such embodiment is shown in FIGS. 3 and 5 in which the inside portion of the housing corresponding to housing segment 37 is divided into first and second areas by ridge 61. The first area has shield engaging means 56 disposed therein and is operable to receive shield 53 and the intervened face portion of strips 54 and 55. The second area is adjacent to frangible section 38 and has roller 57 disposed therein.

The positioning of the second area containing roller 57, relative to the first area is such that the advancing juncture of separation of shield 53 from strips 54 and 55 never reaches roller 57. Thus while roller 57 advances to some small degree within the second area, it does not advance to the degree of the roller in the embodiment of FIGS. 1 and 2.

Roller 57 is in tangential contact with the inside surface of top side wall 30. This inside wall is inclined, relative to the corresponding inside surface of opposing bottom side wall 34, from a distance (*a*) at one end of the area (that adjacent to the first area) equal to at least the diameter of roller 57 to a distance (*b*) at the other end of the area (that adjacent to frangible section 38) equal to less than the diameter of roller 57. This inclined surface performs two important functions. First it automatically prevents skewing of roller 57 since a tendency for advancement of either end of the roller in the course of rotation is countered by the increased resistance against that end. Secondly, as roller 57 advances into this inclined area upon withdrawal of the strips, the roller is compressed by the reduced space, which compression is transferred as increasing pressure upon strips 54 and 55 passing under the roller. While a similar increase in pressure is observed in the arrangement depicted in FIGS. 1 and 2, it results from the incline of the thermometer components themselves and thus the pressure is present only so long as these componenents are in a state of tension. Once strips 54 and 55 are separated from shield 53 in the embodiment of FIGS. 1 and 2, this tension is lost and the strips may merely be urged downward rather than being sufficiently pressed together. Such an event is avoided in the embodiment of FIGS. 3–5 since the increased pressure applied by roller 57 to the thermometer strips is the result of advancement of roller 57 into the incline defined in side wall 30 relative to side wall 34 and is independent of the tension on the thermometer itself.

Figure 7:
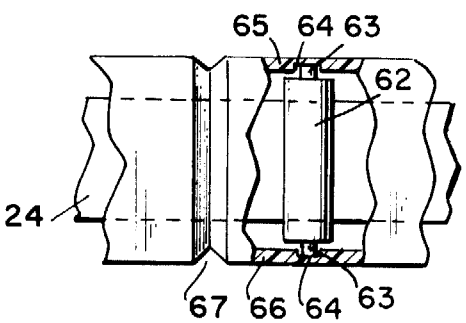
FIG. 7 is a plan view of a portion of a package in accordance with the present invention with a portion of the housing broken away to depict a roller which can be alternatively employed in a package such as that depicted in FIGS. 3, 4 and 5.

It is also possible to rotatably mount the pressing means in the housing. Thus as shown in FIG. 7, roller 62 is mounted through shaft 63 in bearings 64 defined in side walls 65 and 66 of the housing with thermometer 24 passing under. Such an arrangement is disposed near frangible section 67, for the same reasons discussed above in connection with the embodiment of FIGS. 3–5. While roller 62 in tangential contact with the thermometer, it is not in tangential contact with the inside surface of the housing (other than where shafts 63 ride in bearings 64).

As noted above, the housing is preferably fabricated from two coextensive shells having complementary surfaces which are joined together in sealed connection. For purposes of strength, it is generally desirable that this sealed connection is transverse to the plane of the section of reduced wall thickness so that the stress applied to the housing in making the frangible separation is not applied directly to the sealed connection.

The alignment of the two shells can be facilitated by mating pins or guides, as is well known to the art, for which purpose post 56 to which shield 53 is staked can also serve.

The foregoing description of drawings represent typical embodiments of the present invention but are not intended as limitations on the scope thereof, it being apparent that the invention can be practiced through obvious modifications and rearrangements without departing from the essential spirit thereof.

What is claimed is:

1. A package for the complete and protective enclosure of the components of a partially assembled laminated product and the dispensing of the fully assembled product, said components including at least two elongated coextensive strips joined along first portions in face-to-face relationship and intervened along their remaining second face portions by a peelably separable shield operable to prevent face-to-face contact of said second portions prior to dispensing, said package comprising A. a hollow housing of rigid or semi-rigid material, said housing
   1. having opposed spaced apart main side walls and end walls defining a continuous surface fully enclosing said components and
   2. being divided into two segments by a band intermediate to said end walls, said band being defined in said side walls by a section of sufficiently reduced thickness to permit the frangible separation of said housing into two segments upon the application of a levering force, B. product engaging stop means disposed on the inside surface of the housing corresponding to the first of said housing segments, said means being operable to engage and stop the joined portions of said product from complete withdrawal from said first of said housing segments.

C. shield engaging means disposed on the inside portion of the housing corresponding to the second of said housing segments, said means being operable to engage said shield for peelable separation from said strips upon removal of said second strip portions from said second housing segment following frangible separation of said housing, and D. pressing means disposed in that portion of the housing corresponding to the second of said housing segments, said means being operable to urge said unjoined strip portions into face-to-face registry and adhesive contact following unshielding in the course of removal of said second strip portions from said second segment.

2. A package according to claim 1 wherein said pressing means is a roller.

3. A package according to claim 2 where said roller is rotatably mounted in said housing.

4. A package according to claim 2 wherein said roller is freely disposed in said housing and in tangential surface contact with the inner surface of one of said side walls, said roller rotatably advancing towards the section of frangible separation in the course of removal of said second strip portions.

5. A package according to claim 4 including means operable to prevent skewing of said roller during said rotatable advancement.

6. A package according to claim 4 wherein the inside surface of the wall with which said roller is in contact and the inside surface of its opposing wall are in substantially parallel alignment throughout at least the area of rotatable advancement of said roller.

7. A package according to claim 4 wherein the inside portion of the housing corresponding to the second of said housing segments is divided into first and second areas said first area having said shield engaging means disposed therein and being operable to receive said shield and said intervened face portions of said strips and said second area being adjacent to said frangible section and having said roller disposed therein, the inside surface of the side wall of said housing with which said roller is in tangential contact in said second area being inclined, relative to the corresponding inside surface of the opposing side wall, from a distance at that end of said second area adjacent to said first area equal to at least the diameter of the roller to a distance at that end of said second area adjacent to said frangible section equal to less than the diameter of the roller.

8. A package according to claim 7 wherein said roller is elastic.

9. A package according to claim 7 wherein said housing comprising two coextensive shells of said rigid or semi-rigid material having complementary surfaces which are joined to one another in sealed connection transverse to said section of reduced wall thickness.

10. A package according to claim 1 wherein said product engaging means are stop means disposed on the inside surface of the housing corresponding to the first of said segments and operable to permit limited sliding of the joined portions of said product from said segment following frangible separation of said housing with subsequent engagement of cooperating stop means on said joined portions of the product to limit said sliding and prevent removal of said joined portions from said first segment.

11. A package according to claim 10 including locking means operable to prevent retraction of said joined portions into said first segment following engagement of said product stop means by said housing stop means.

12. A package for the complete and protective enclosure of the components of a partially assembled disposable thermometer and the dispensing of the fully assembled thermometer, said components including at least two elongated coextensive strips joined adhesively along first portions in face-to-face relationship and intervened along their remaining second face portions by a peelably separable shield operable to prevent face-to-face contact of said second portions prior to dispensing, said second face portions when in face-to-face contact being operable to detect and indicate temperature within a predetermined range, said package comprising A. a hollow housing of rigid or semi-rigid material, said housing
   1. having opposed spaced apart main side walls and end walls defining a continuous surface fully enclosing said components,
   2. being divided into two segments by a band intermediate to said end walls, said band being defined in said side walls by a section of sufficiently reduced thickness to permit the frangible separation of said housing into two segments upon the application of a levering force, a first of said housing segments receiving said joined portions of said thermometer strips and the second of said housing segments receiving said shield and shield intervened second portions of said thermometer strips, and 3. consisting of two coextensive shells having complementary surfaces which are joined to one another in sealed connection transverse to said section of reduced wall thickness, B. stop means disposed on the inside surface of the housing corresponding to the first of said segments and operable to 1. permit limited sliding of the joined portions of said thermometer from said segment following frangible separation of said housing and 2. engage cooperating stop means on said joined portions to limit said sliding and prevent removel of said joined portions from said first segment C. locking means disposed within said first segment and operable to prevent retraction of said joined portions following engagement of said thermometer stop means by said housing stop means D. shield engaging means disposed on the inside portion of the housing corresponding to the second of said housing segments and operable to engage said shield for peelable separation from said strips upon removal of said second strip portions from said second housing segment following frangible separation of said housing; and E. pressing means disposed in that portion of the housing corresponding to the second of said housing segments, said means being operable to urge said unjoined strip portions into face-to-face registry and adhesive contact following unshielding in the course of removal of said strip portions from said second segment.

13. A package according to claim 12 wherein said pressing means is an elastic roller freely disposed in said housing in tangential contact with the inner surface of one of said side walls for rotatable advancement towards the section of frangible separation in the course of removal of said second strip portions, the inside surface of its opposing side wall being in substantially parallel alignment throughout at least the area of rotatable advancement of said roller.

14. A package according to claim 12 wherein said pressing means is an elastic roller and the inside portion of the housing corresponding to said second segment is divided into first and second areas, said second area being adjacent to said frangible section and having said roller disposed therein in tangential contact with the inner surface of one of said side walls in said area, said inner surface of said side wall being inclined, relative to the corresponding inside surface of the opposing side walls, from a distance at that end of said second area adjacent to said first area equal to at least the diameter of the roller to a distance at that end of said second area adjacent to said frangible section equal to less than the diameter of the roller.

* * * * *